US007503743B1

(12) United States Patent
Friedrich

(10) Patent No.: US 7,503,743 B1
(45) Date of Patent: Mar. 17, 2009

(54) MANHOLE COVER LIFT

(75) Inventor: Peter Friedrich, Boyne City, MI (US)

(73) Assignee: Industrial Magnetics, Inc., Boyne City, MI (US)

( * ) Notice: Subject to any disclaimer, the term of this patent is extended or adjusted under 35 U.S.C. 154(b) by 186 days.

(21) Appl. No.: 11/582,724

(22) Filed: Oct. 18, 2006

Related U.S. Application Data

(63) Continuation-in-part of application No. 11/199,940, filed on Aug. 9, 2005.

(60) Provisional application No. 60/648,812, filed on Feb. 1, 2005.

(51) Int. Cl.
*B66F 3/00* (2006.01)

(52) U.S. Cl. ..... 414/684.3; 254/131; 212/901

(58) Field of Classification Search ..... 414/684.3; 254/131; 212/901
See application file for complete search history.

(56) References Cited

U.S. PATENT DOCUMENTS 4,365,925 A 12/1982 Girtz
4,482,182 A 11/1984 Mortensen
4,789,072 A 12/1988 Quam et al.
4,826,388 A 5/1989 Golding
5,035,336 A 7/1991 Schmitz et al.
5,165,661 A 11/1992 Wright
5,382,131 A 1/1995 Werthmann
5,462,385 A 10/1995 Mohlengraft
6,682,049 B2 1/2004 Thompson
2003/0146633 A1 8/2003 Jung

OTHER PUBLICATIONS

U.S. Saws brochure, The "Magnetic Manhole Buddy," obtained from internet on or about Sep. 1, 2006.

*Primary Examiner*—Donald Underwood
(74) *Attorney, Agent, or Firm*—Young Basile

(57) ABSTRACT

An apparatus for moving a manhole cover comprising a lever having a first lever arm pivotally connected to a second lever arm by a hinge for movement between a collapsed position, wherein the first lever arm is substantially parallel to the second lever arm, and a plurality of operative positions, wherein the first lever arm extends at a non-parallel angle with respect to the second lever arm. A linkage is connected to an engaging end of the lever, and at least one magnet is connected to the linkage and engageable with the manhole cover.

20 Claims, 9 Drawing Sheets

MANHOLE COVER LIFT

This application is a continuation-in-part of U.S. patent application Ser. No. 11/199,940, filed on Aug. 9, 2005, which claims the benefit of U.S. Provisional Patent Application No. 60/648,812, filed on Feb. 1, 2005.

FIELD OF THE INVENTION

The present invention relates to manhole cover lifting devices, and more particularly, to manhole cover lifting devices that utilize levers and magnets.

BACKGROUND OF THE INVENTION

The difficulties inherent in removing and maneuvering manhole covers is both well-known in practice and well-documented in patent literature. The realities of modern automobiles and transportation thoroughfares have long dictated the necessity for sturdy steel and iron access coverings most traditionally associated with urban drainage tunnels. More recently, many public utility companies have also taken to underground routing for their various service conduits, be they gas, electric, cable, or telephone. Although underground tunnels for these sorts of utility services are sometimes located away from automobile thoroughfares, the standard steel or cast iron manhole cover appears well entrenched for use in these and other varied applications. Accordingly, the injury risks associated with removing and replacing manhole covers remain common to many people in the modern workforce.

Prior art devices that have attempted to address the problems inherent in removing, moving, and replacing manhole covers and storm sewer grates are of two general types. The first type consists of devices that rely upon mechanical or geometric interfaces with the manhole cover. Since the detail, location, and design of holes, slots, cleats, clevises, and the like vary from one manhole cover to another, devices relying upon purely mechanical interfaces necessarily require a host of adapters and other accessories that enable one device to be of universal use for all manhole covers. Thus, while devices of this type may succeed in preventing injury, they are complex, often occupying a workman's valuable time with detailed and tedious efforts to select, set up, and correctly use the necessary adapters for any particular manhole cover, provided that he has not lost or misplaced the requisite parts along the way.

The second general type of prior art device consists of those devices that are so over-engineered and bloated with detail that many approach a size and weight rivaling that of the average manhole cover. Such devices employ one or more of electromagnets, pulleys, gears, and hydraulics to the point that such "solutions" to the original problems posed by manhole covers are problematic in their own right. These devices have either a superfluity of moving parts or are of such a size that a workman risks injury in the process of loading or unloading the device from his vehicle.

It is therefore desirable to have a simple, portable device that eliminates the risk of injury in the processes of removing, moving, and replacing manhole covers that is at once versatile and both lightweight and compact. The present invention addresses itself to these concerns.

SUMMARY OF THE INVENTION

The present invention is an apparatus for moving a manhole cover comprising a lever having a first lever arm pivotally connected to a second lever arm by a hinge for movement between a collapsed position and a plurality of operative positions. In the collapsed position, the first lever arm is substantially parallel to the second lever arm. In each of the plurality of operative positions, the first lever arm extends at a non-parallel angle with respect to the second lever arm. The apparatus may include a locking member engageable with the hinge and engageable with the first lever arm for restraining pivotal movement of the first lever arm with respect to the second lever arm. Furthermore, a linkage is connected to an engaging end of the lever, and at least one magnet is connected to the linkage and engageable with the manhole cover.

The magnet has an interface surface that is selectively engageable with the manhole cover. The magnet also has a handle moveable between an engaged position, wherein a magnetic flux is emitted through the interface surface of the magnet, and a disengaged position, wherein substantially no magnetic flux is emitted through the interface surface of the magnet. Furthermore, the magnet may be an electromagnet.

The linkage may be a hook, and a slot may be provided in the second lever arm of the lever, wherein the hook is disposed within the slot. Furthermore, a plurality of holes may be provided on the hook, wherein each hole is engageable with the second lever arm of the lever. The linkage may have a chain, and the linkage may have a spreader bar.

A handle may be connected to the first lever arm of the lever. Additionally, the apparatus may have a wheel for moveably supporting the lever and a wheel chalk.

DESCRIPTION OF THE ILLUSTRATED EMBODIMENTS

Figure 1:
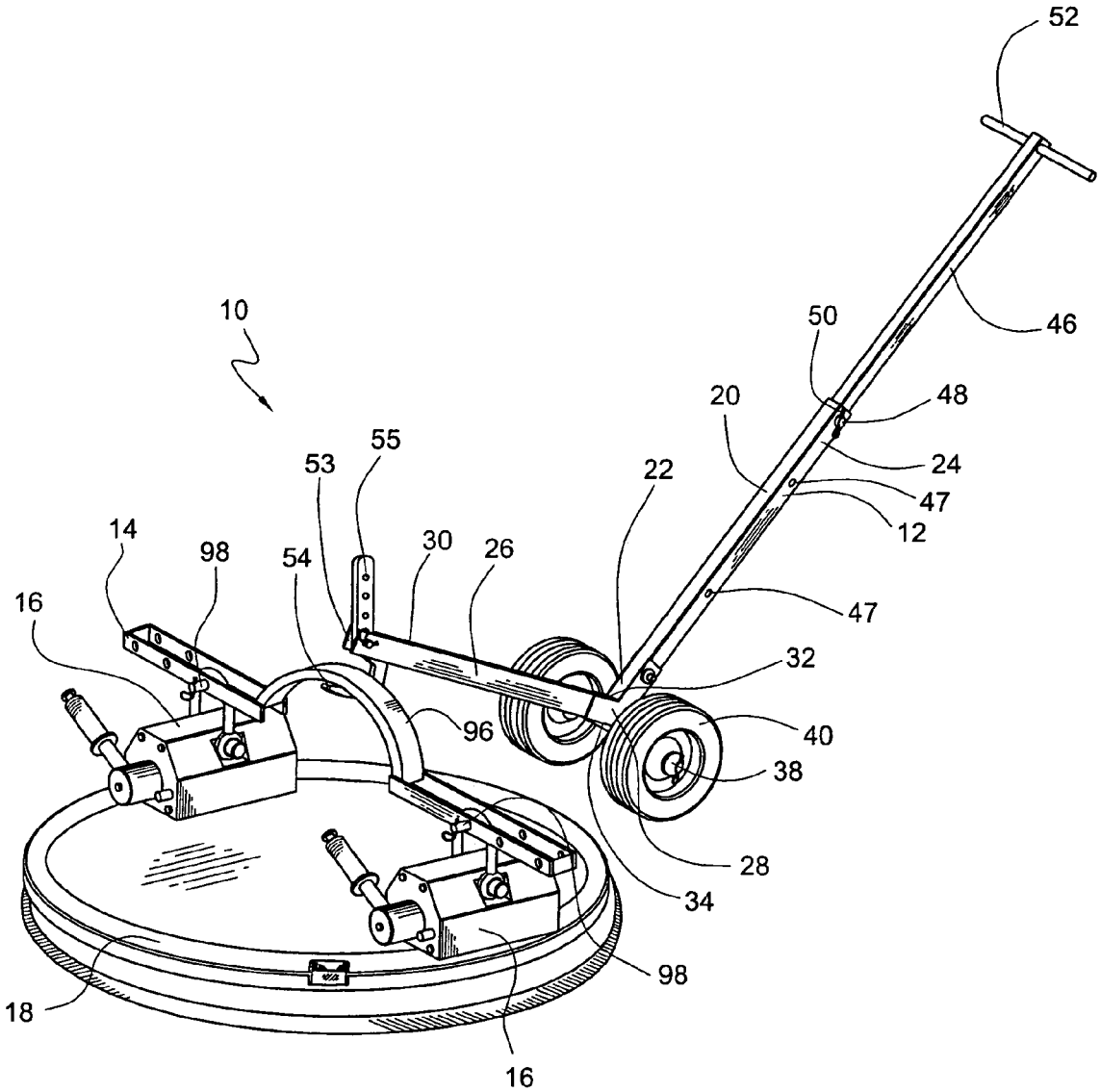
FIG. 1 is a perspective view of the manhole cover lift of the present invention showing a spreader bar and two magnets in use lifting a manhole cover.

FIG. 1 shows a manhole cover lift 10 of the present invention. The manhole cover lift 10 comprises a lever 12, a spreader bar 14, and one or more magnetic units 16. As shown in FIG. 1, the lever 12 of the manhole cover lift 10 engages with the spreader bar 14 which, in turn, engages with magnetic units 16, which are in magnetic contact with a manhole cover 18.

Figure 6:
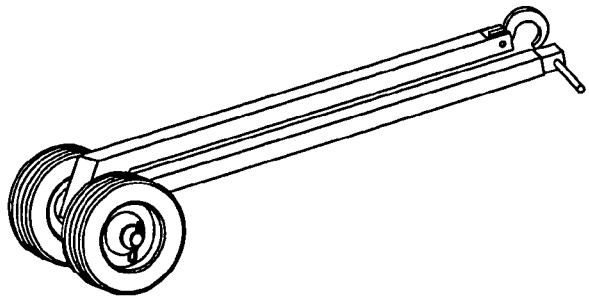
FIG. 6 is a perspective view of the lever of the present invention showing the lever in a collapsed orientation.

The lever 12 is suitable for many heavy lifting applications. The lever 12 comprises a first lever arm 20 having a fulcrum end 22 and a handle end 24. The first lever arm 20 is a substantially rigid tube or bar suitable for withstanding and transmitting bending loads of a magnitude typically found in manhole cover lifting operations. The fulcrum end 22 of the first lever arm 20 is rigidly connected to a second lever arm 26. The second lever arm 26 is a substantially rigid tube or bar having a fulcrum end 28 and a load-engaging end 30. Fulcrum ends 22 and 28 of lever arms 20 and 26 are attached at a joint 32. The joint 32 achieves the mating of the first lever arm 20 and second lever arm 26 at an obtuse angle, although other angles may be used. Lever arms 20 and 26 thereby substantially define a plane (not shown). The joint 32 may be a fixed joint, as in a welded connection, or it may be hinged, allowing the lever 12 to be collapsed as shown in FIG. 6 for ease in transportation and storage. As can be better seen in FIGS. 2 and 4, a rigid tube 34 is attached near the joint 32. The tube 34 is substantially perpendicular to the plane formed by lever arms 20 and 26. Additionally, the longitudinal axis (not shown) of the tube 34 substantially defines a fulcrum point for the lever 12.

Figure 8:
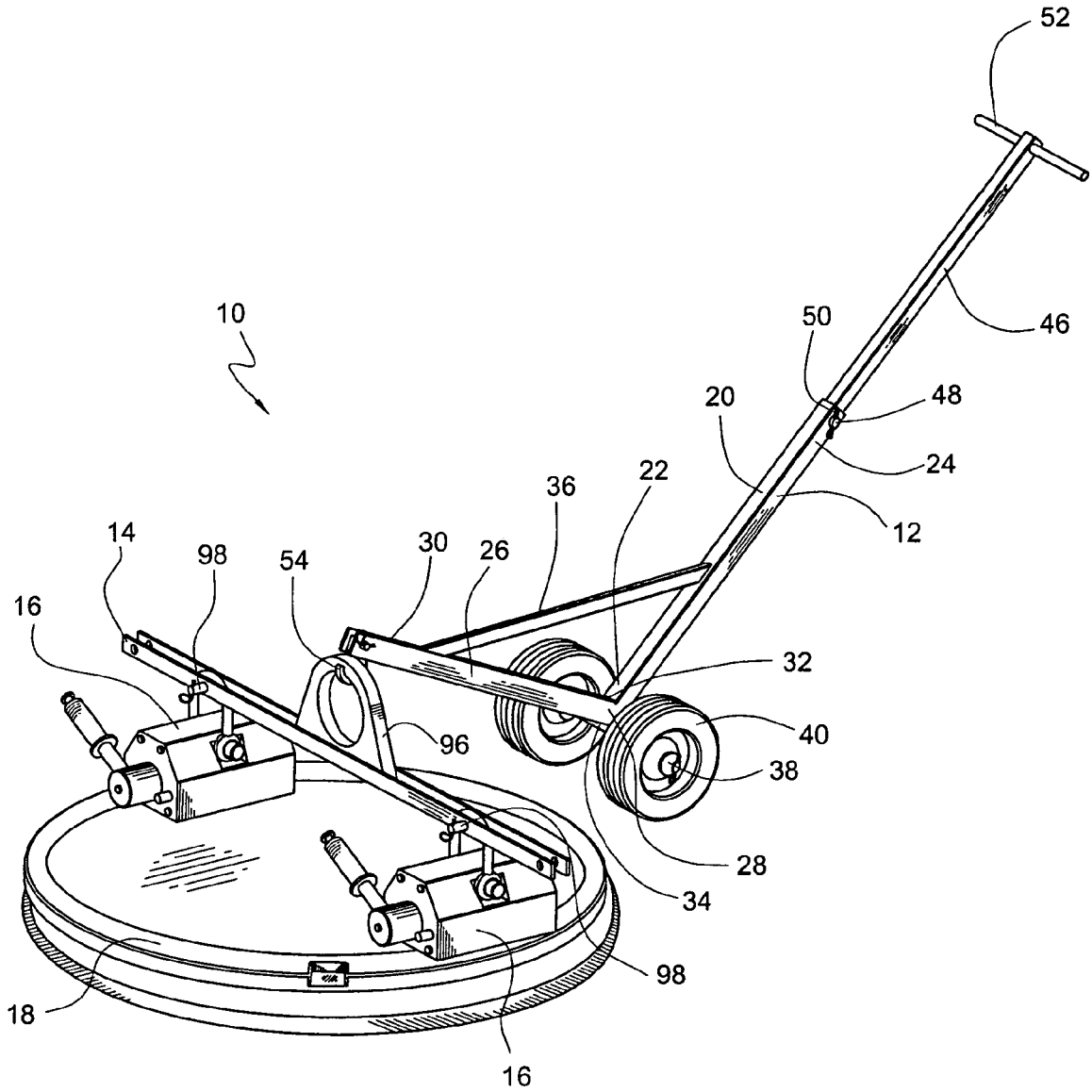
FIG. 8 is a perspective view of an embodiment of the manhole cover lift of the present invention showing a brace member, hook, and spreader bar.

Lever arms 20 and 26 may be formed from any of various substantially rigid materials that are capable of bearing and transmitting bending loads of a magnitude typically generated by the application of a lever to a manhole cover. Further, lever arms 20 and 26 may be made from square or round tubing or, alternatively, may be substantially solid members. In the embodiment shown in FIG. 8, wherein the joint 32 is not hinged, lever arms 20 and 26 may be further connected by a substantially rigid brace member 36. The brace member 36 is rigidly attached to the first lever arm 20 at a point between its fulcrum end 22 and handle end 24. Similarly, brace member 36 is rigidly attached to the second lever arm 26 at a point between its fulcrum end 28 and load-engaging end 30. In this fashion, the brace member 36 lies substantially within the plane formed by lever arms 20 and 26 and provides added support to the lever 12.

In order to provide mobility to the lever 12, an axle 38 is provided inside the tube 34. Wheels 40 are rollably mounted on the axle 38 on either side of the first and second lever arms 20 and 26. The axle 38 and wheels 40 are sized so that a portion of the axle 38 extends through and protrudes from a central hole in each wheel 40 a sufficient amount to accommodate a washer 42 and cotter pin 44 that, in combination, secure each wheel 40 to the axle 38. Alternatively, wheels 40 may be welded to the axle 38 or attached with a lock nut or other fastener (not shown). The wheels 40 are made of substantially rigid materials with the treads made from rubber, plastic, or other material suitable for rollably supporting the lever 12. As depicted in FIGS. 1-4, the wheels 40 are non-pneumatic, although pneumatic wheels may be provided on the axle 38 in order to accommodate specific work site environments requiring the use of pneumatic wheels.

In order to increase the mechanical advantage of the first and second lever arms 20 and 26 of the lever 12, a handle 46 is provided on the handle end 24 of the first lever arm 20. The handle 46 is a substantially rigid tube or bar capable of bearing and transmitting the bending loads typical of manhole cover lifting operations. The handle 46 is partially telescoped within the first lever arm 20. The handle 46 is secured to the lever arm 20 by a pin 48 that resides in corresponding holes 47 provided in both the handle 46 and lever arm 20. A cotter pin 50 is provided through the pin 48 in order to prevent it from falling out of the holes 47 in the handle 46 and lever arm 20 during use. One or more grips 52 are provided at the end of handle 46 remote from its connection with the first lever arm 20. The grips 52 are attached to the handle 46 and are oriented substantially normal to the plane formed by lever arms 20 and 26. A rubber or plastic coating (not shown) may be provided on the grips 52 in order to provide a more secure interface with a user's hands. It will be appreciated by those in the levered arts that increasing the distance between the fulcrum, located at the axle 38, and the grips 52 results in an increase in mechanical advantage for the manhole cover lifting operation. For this reason, three sets of holes 47 are provided along the length of the first lever arm 20 in order to allow for such adjustments and to accommodate users of different heights. The handle 46 may be permanently attached to the first lever arm 20 by means other than the pin 48, or the handle 46 may be removable. Alternatively, the handle 46 may be attached to the first lever arm 20 by way of a hinge (not shown) to accommodate a folded orientation for the lever 12.

As can be seen from FIGS. 1-4, the load engaging end 30 of the second lever arm 26 can support a variety of linkages for engaging a load. Turning first to the embodiment depicted in FIGS. 1 and 4, the load engaging end 30 of the second lever arm 26 has a slot 53 which accommodates a hook 54 having a plurality of holes 55 that is connected by a load support pin 56 and cotter pin 58 to the load engaging end 30 of the second lever arm 26. Both the hook 54 and load support pin 56 are of a size and material sufficient to withstand the loading and shearing forces encountered in a manhole cover lifting operation. The plurality of holes 55 in the hook 54 allows the user to adjust the interface height of the hook 54, load engaging end 30, and lever arm 26 with respect to the item being lifted. This may result in a change to the height of the handle 46 and grips 52 as well.

Figure 2:
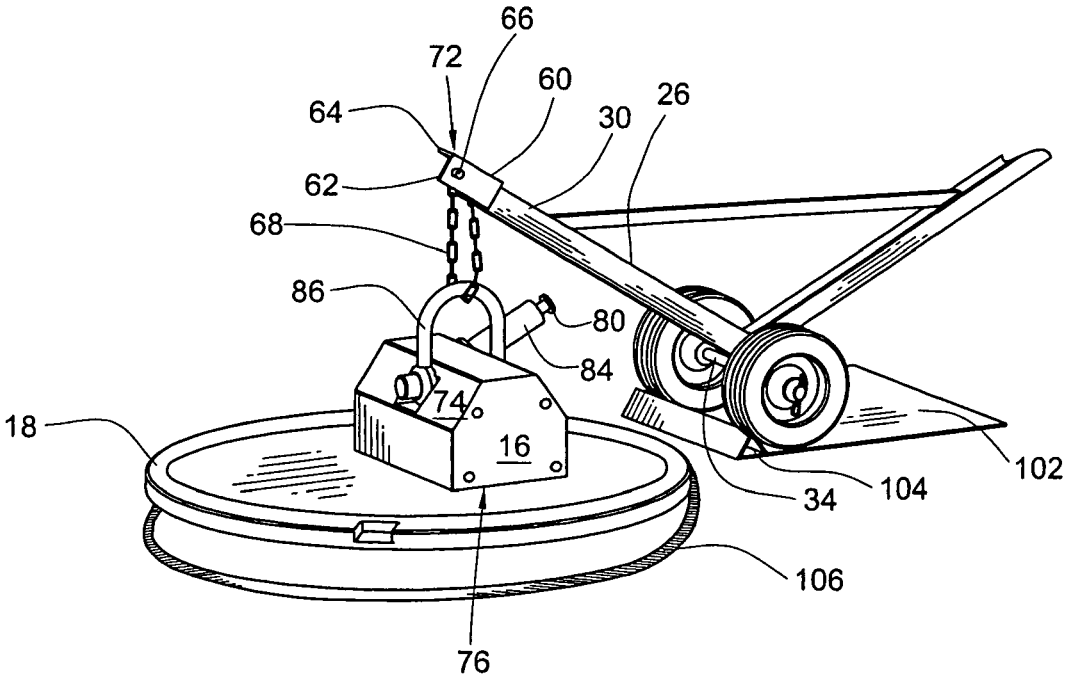
FIG. 2 is a partial perspective view of an embodiment of the manhole cover lift of the present invention showing the use of single magnet and wheel chock in lifting a manhole cover.
Figure 3:
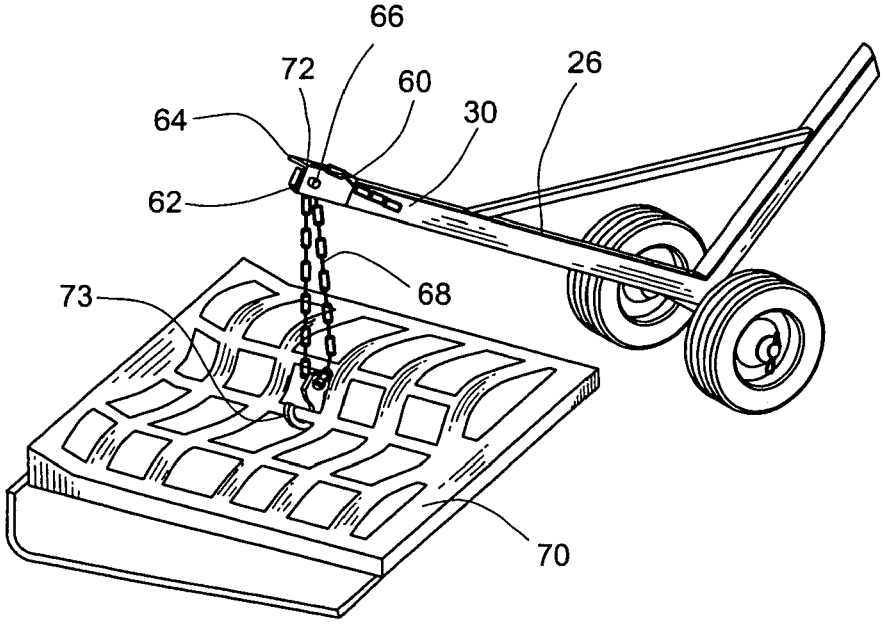
FIG. 3 shows an embodiment of the manhole cover lift of the present invention having an articulable chain engaging and lifting a storm sewer drain cover.

Turning to FIGS. 2 and 3, an alternative embodiment for the load engaging end 30 is shown. In this embodiment, a piece of angle iron 60 is attached to the load engaging end 30 of the second lever arm 26. The piece of angle iron 60 is welded or otherwise substantially rigidly attached to the load engaging end 30 of the second lever arm 26 through a connection that is able to withstand the loading and shearing forces typically found in a manhole cover lifting operation. The angle iron 60 is oriented such that a first flange 62 of the piece of angle iron 60 lies substantially within the plane formed by first and second lever arms 20 and 26. A second flange 64 of the piece of angle iron 60 is oriented at an angle substantially normal to the first flange 62. A bolt 66 is provided through a hole (not shown) in the first flange 62. Washers and nuts (not shown) may be provided in association with the bolt 66 in order to securely fasten a first portion of a continuously articulable member 68 to the first flange 62. The continuously articulable member 68 is of a size and weight capable of transmitting the tensile forces typically associated with the vertical displacement of a manhole cover 18 or storm drain cover 70, such as a chain, cable, rope, strap, or the like.

A notch 72 is provided in the second flange 64 of the piece of angle iron 60. The notch 72 is sized to accommodate a portion of the continuously articulable member 68, such as an individual chain link. In use, a portion of the continuously articulable member 68, such as an individual chain link, a clamp on a cable, or a knot in a rope or strap, is inserted into the notch 72 and the frictional forces generated between the surface of the second flange 64 and, for example, an adjacent chain link, prevent the inserted portion from slipping out of the notch 72. The presence of this notch 72 allows the user to adjust the distance between the load engaging end 30 of the second lever arm 26 and the load itself by adjusting the portion of the continuously articulable member 68 in use. The adjustability feature provided by the notch 72 in conjunction with the continuously articulable member 68 allows the load engaging end 30 of the lever 12, and consequently the grips 52 of the handle 46, to be adjusted to a height suitable for a specific application or user. Similarly, the continuously articulable member 68 may be used alone or in conjunction with a grate hook 73 to engage a variety of geometries, including such irregular shapes as a storm drain cover 70 as depicted in FIG. 3.

Figure 4:
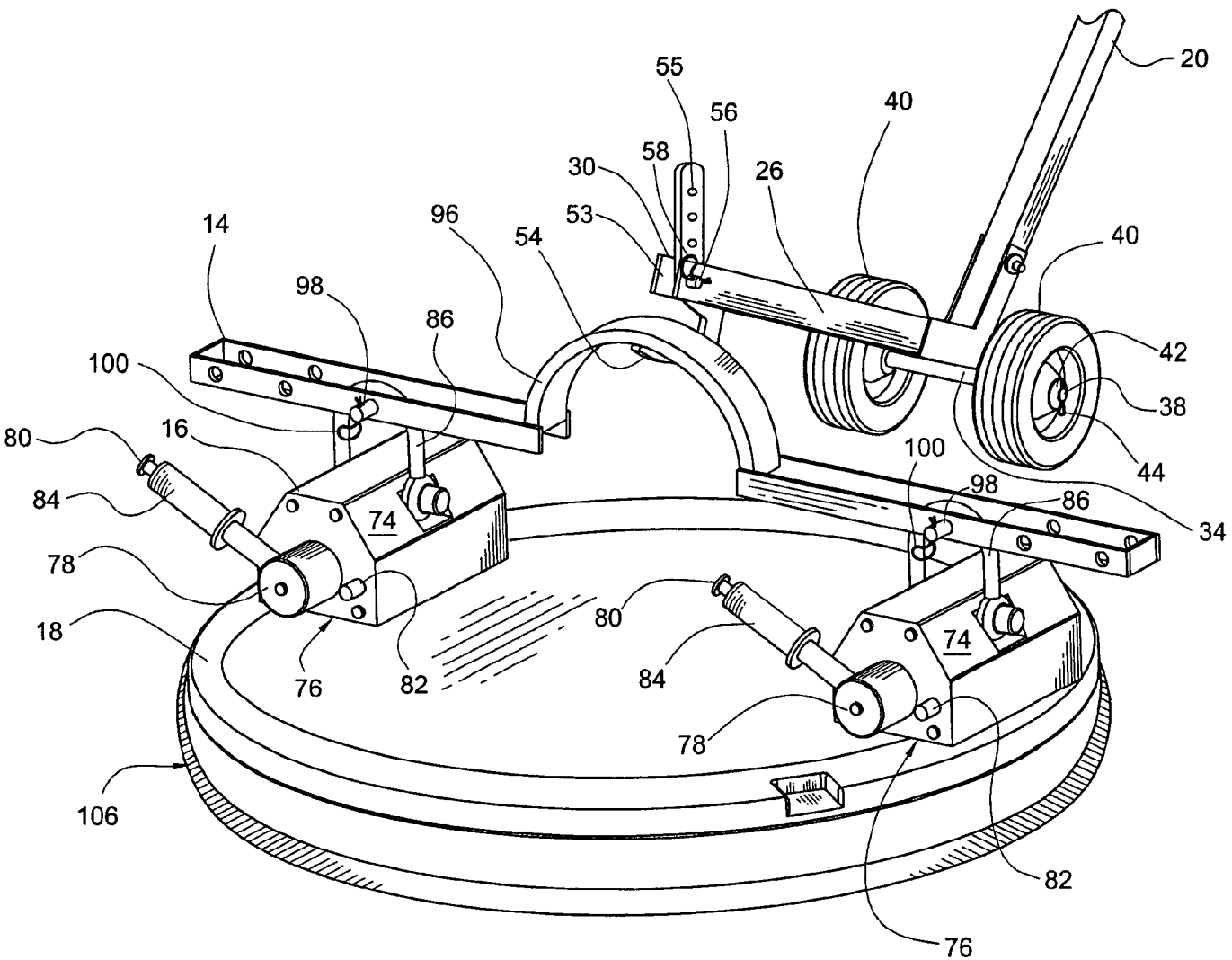
FIG. 4 is a partial perspective view of the manhole cover lift of the present invention showing an enlarged view of the spreader bar and magnets engaged in lifting a manhole cover.

FIGS. 1, 2, and 4 each show one or more magnetic units 16 for use in engaging a manhole cover 18. Each magnetic unit 16 has a housing 74 that includes an interface surface 76. The interface surface 76 is substantially flat and smooth. The housing 74 encloses rare earth magnetic materials or other magnetic materials oriented to selectively apply a magnetic flux through the interface surface 76. A cam 78 is provided at one end of the housing 74 of the magnetic unit 16. The cam 78 is rotatable on an axis substantially parallel to the longitudinal axis (not shown) of the magnetic unit 16. The cam 78 moves one or more portions of the rare earth or other magnetic materials (not shown) mounted inside of the housing 74 of the magnetic unit 16. In one orientation, a disengaged position, the magnetic materials connected to the cam 78 are oriented with respect to the other magnetic materials within the housing 74 in order to minimize the amount of magnetic flux emitted through the interface surface 76. In a second orientation, an engaged position, the magnetic materials connected to the cam 78 are oriented in such a way with respect to other magnetic materials within the housing 74 of the magnetic unit 16 that a magnetic flux is produced through the interface surface 76 and is engageable with any of a variety of ferrous metals or materials of a type commonly found in manhole covers 18 and storm drain covers 70. A handle 80 is provided on the cam 78. The handle 80 serves to rotate the cam 78 between engaged and disengaged positions, which positions are substantially defined by stops 82 that physically interfere with the travel of the handle 80 in order to define engaged and disengaged positions for the magnetic unit 16. A grip 84 of rubber or plastic material may be provided on the handle 80 in order to provide a surface having an improved coefficient of friction for interfacing with a user's hands. A bail 86 is attached to the housing 74 of the magnetic unit 16. The bail 86 is of a size large enough to accommodate hooks and other engaging devices of a size typically found on heavy-duty cranes and hoists, allowing the magnetic unit 16 to be used by additional devices beyond the manhole lift lever 12.

Figure 7A:
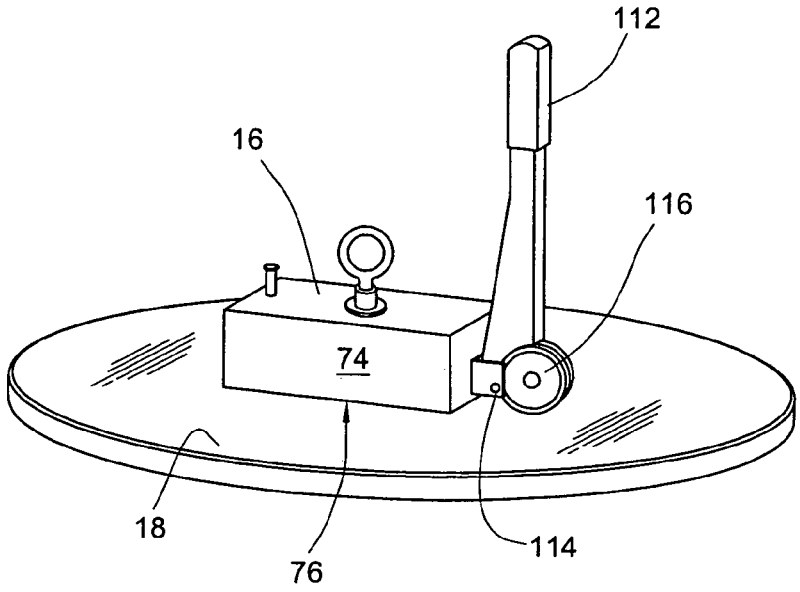
FIG. 7A is a perspective view of a magnetic unit connected to a manhole cover.
Figure 7B:
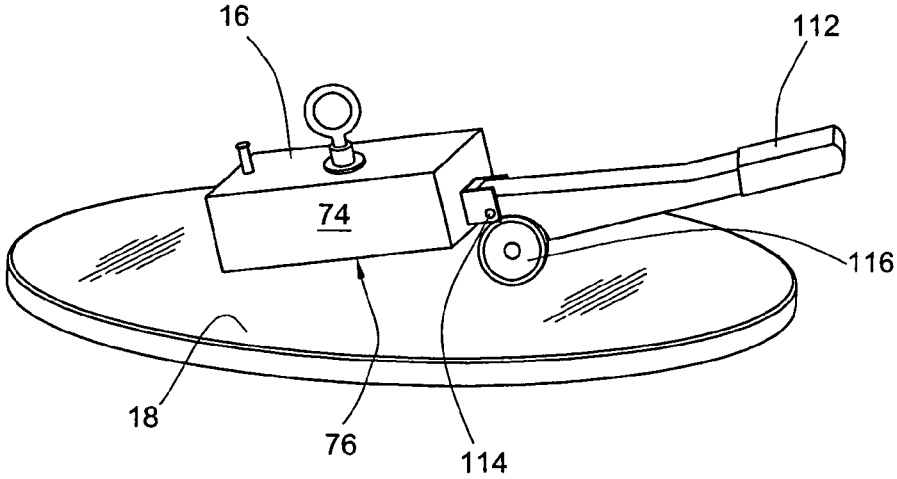
FIG. 7B is a perspective view of a magnetic unit being released from its attachment to a manhole cover.

Alternatively, a variety of different magnets may be used or incorporated into the design of magnetic unit 16. One such alternative appears in FIGS. 7A and 7B. As shown in FIGS. 7A and 7B, the magnetic unit 16 is comprised of one or more permanent or conventional magnets within a housing 74. FIG. 7A depicts the magnetic unit 16 in an engaged position with the manhole cover 18 wherein the interface surface 76 is substantially flush with the surface of the manhole cover 18, and a magnetic flux through the interface surface 76 engages the manhole cover 18. A release lever 112 is provided at one end of the magnetic unit 16. Since, in this embodiment, the magnets within the housing 74 are permanent, the magnet flux emitted through the interface surface 76 is substantially constant. Thus, in order to disengage the magnetic unit 16 from the manhole cover 18, the release lever 112 and associated fulcrum 114 is provided with a roller 116 located at a point on the lever away from the fulcrum 114. FIG. 7B depicts the magnetic unit 16 being disengaged from the manhole cover 18 wherein the release lever 112 is rotated about the fulcrum 114 in order to bring the roller 116 into rollable contact with the manhole cover 18, thus elevating one end of the housing 74 of the magnetic unit 16 and substantially separating the magnetic unit 16 from the manhole cover 18. In the position depicted in FIG. 7B, the magnetic unit 16 can then be manually removed from the manhole cover 18. Other embodiments of magnetic unit 16 are possible, including electromagnets with associated electrical circuits (not shown). In the case of such electromagnets, a controller (not shown) such as a switch, rheostat, or the like, may be provided in conjunction with one or more electrical circuits in order to control the magnetic flux of the one or more electromagnets. The switch, rheostat, or other controller (not shown) provides the ability to create an engaged state where the one or more electromagnets emits a magnetic flux and a disengaged state wherein the one or more electromagnets emits substantially no magnetic flux.

Figure 5:
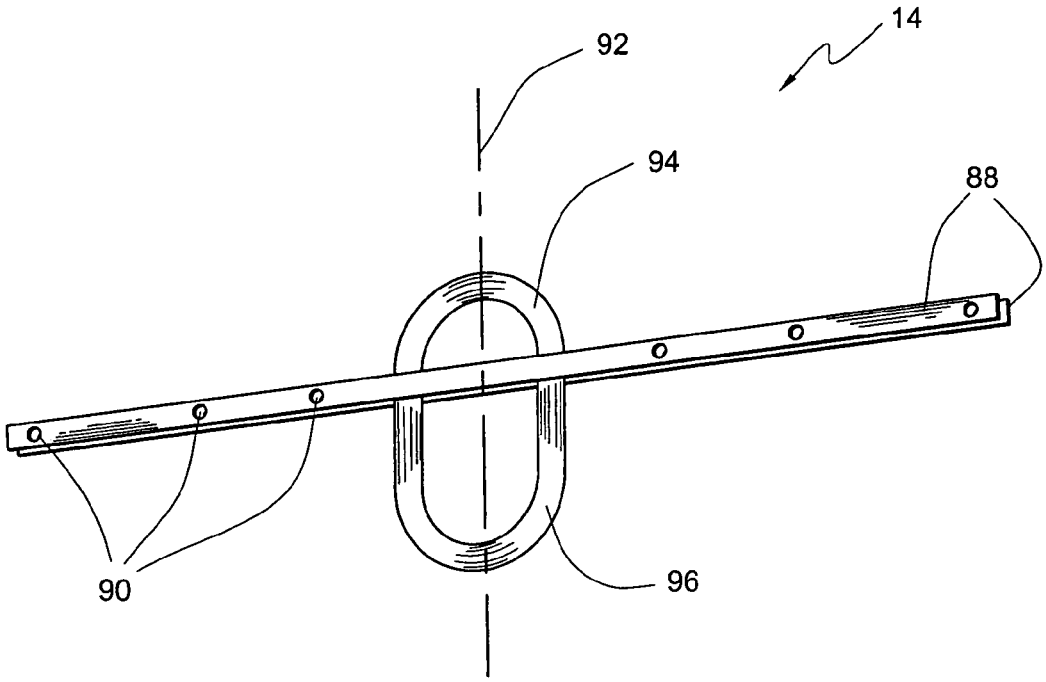
FIG. 5 is a perspective view of a spreader bar for use as a linkage in the present invention.

Turning now to FIG. 5, a spreader bar 14 is shown for allowing a manhole lift lever 12 to interface with two or more magnetic units 16, as depicted in FIGS. 1 and 4. The spreader bar 14 comprises a pair of substantially rigid rails 88, each provided with a plurality of corresponding holes 90. The holes 90 in each of the rails 88 are arranged symmetrically about a central axis 92 of the spreader bar 14. A small bail 94 and large bail 96 are provided between rails 88 in the spreader bar assembly 14. Each of the bails 94 and 96 are securely attached to the rails 88 by fasteners, welds, or other means suitable for withstanding and transmitting the forces associated with a manhole cover lifting operation. Both the rails 88 and the bails 94 and 96 may be made from steel, heavy aluminum, or other substantially rigid material suitable for use in heavy lifting applications. FIGS. 1 and 4 show an alternative embodiment of the spreader bar 14 having only a large bail 96. The spreader bar 14 allows the use of two magnetic units 16 for lifting a single manhole cover 18. The spreader bar 14 aids in centering the load at the point of the bails 94 or 96. The hook 54 or continuously articulable member 68 of the lever 12 may then be used to engage one of the bails 94 or 96 of the spreader bar 14. Each of the bails 86 of the magnetic units 16 are attached to the spreader bar 14 with a pin 98 provided through the holes 90 in the rails 88 of the spreader bar 14. Each pin 98 is further secured in place by a cotter pin 100. Although not shown in the drawing figures, a lever 12 having an angle iron 60 and continuously articulable member 68 as depicted in FIGS. 2 and 3 could also be used in conjunction with a spreader bar 14 and multiple magnetic units 16. Conversely, the lever 12 as shown in FIGS. 1 and 4 having a hook 54 at the load engaging end 30 of the second lever arm 26 could be used in conjunction with a single magnetic unit 16 as depicted in FIG. 2. The hook 54 provides a measure of simplicity compared to the angle iron 60 and continuously articulable member 68 arrangement, however, as mentioned, the angle iron 60 and continuously articulable member 68 arrangement provides a slightly greater degree of adjustability compared to the hook 54. Additionally, it may be possible to use a chain or other continuously articulable member in conjunction with the hook 50 to allow for additional adjustability of the lever 12 as described above.

Turning finally to FIG. 2, a plate 102 having a wheel chock 104 is provided in order to secure the wheels 40 of the lever 12 from advancing toward the manhole 106 in the course of a manhole cover lifting operation. Such a plate 102 having a wheel chock 104 is particularly useful when the surface surrounding the manhole 106 and manhole cover 18 is substantially uneven or when a user attempts a manhole cover lifting operation on a steep grade. Even in normal lifting operations, the plate 102 and wheel chock 104 provide a measure of safety over the use of a manhole cover lift 10 without such a device.

In operation, the user of a manhole cover lift 10 first examines the surface of the manhole cover 18 to determine the most appropriate location for engaging the manhole cover 18. Magnetic units 16 are most effective on substantially even and substantially flat manhole surfaces. Thus, the user inspects the manhole cover 18 to determine where such suitable surfaces are located. If the flattest portion of the manhole cover 18 is near its center, the user would select a single magnetic unit 16 for engaging the manhole cover 18. Alternatively, if the central portion of the manhole cover 18 contains an uneven surface or a decorative design, such a manhole cover may have more suitable flat surfaces toward its perimeter. In that case, the user would select two magnetic units 16 in conjunction with a spreader bar 14 in order to complete the lifting operation. Whether one or two magnetic units 16 are used, the user ensures that either the bail 86 of the magnetic unit 16 or the bail 94 or 96 of the spreader bar 14 is aligned substantially over the center point of the manhole cover 18. Once the one or more magnetic units 16 and, if used, spreader bar 14, are in place on the manhole cover 18, the user then places the plate 102 with wheel chock 104 adjacent to the manhole cover 18, and wheels the lever 12 to a position where the wheels 40 are located on the plate 102 and engage with the wheel chock 104 such that the hook 54 or continuously articulable member 68 is located substantially over the bail 86, 94, or 96 to be engaged. The user next engages the hook 54 or continuously articulable member 68 with the bail 86, 94, or 96, and begins the lifting procedure by applying a substantially downward force on the grips 52 of the handle 46. Once the manhole cover 18 is lifted clear of the manhole 106, the user may then either rotate or translate the lever 12 away from the manhole 106 in order to expose the opening of the manhole 106. Once the manhole cover 18 is appropriately moved, the user gradually decreases the force applied to the grips 52 in order to allow the manhole cover 18 to come to rest upon the ground. This procedure is substantially reversed in order to place the manhole cover 18 back on the manhole 106.

Figure 9:
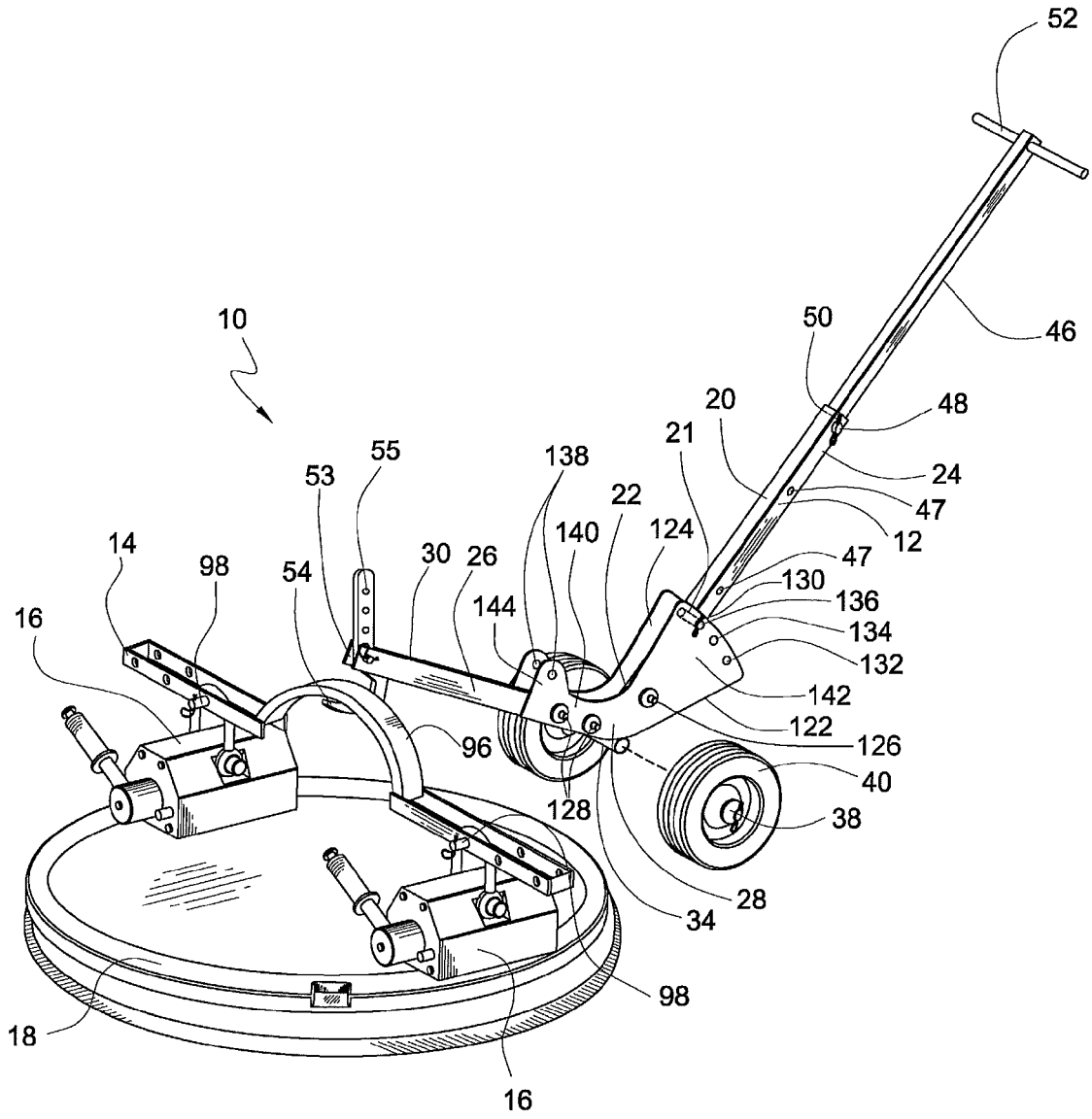
FIG. 9 is a perspective view of an embodiment of the manhole cover lift of the present invention having a hinge pivotally connecting the first lever arm to the second lever arm for movement between a collapsed position and a plurality of operative positions.
Figure 10A:
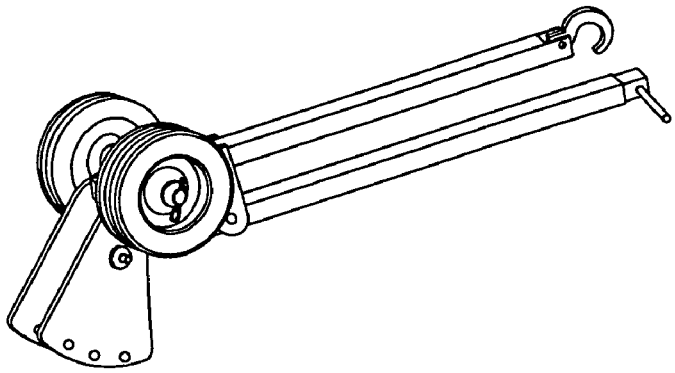
FIG. 10A is a perspective view of the embodiment shown in FIG. 9, wherein the first lever arm is in the collapsed position.
Figure 10B:
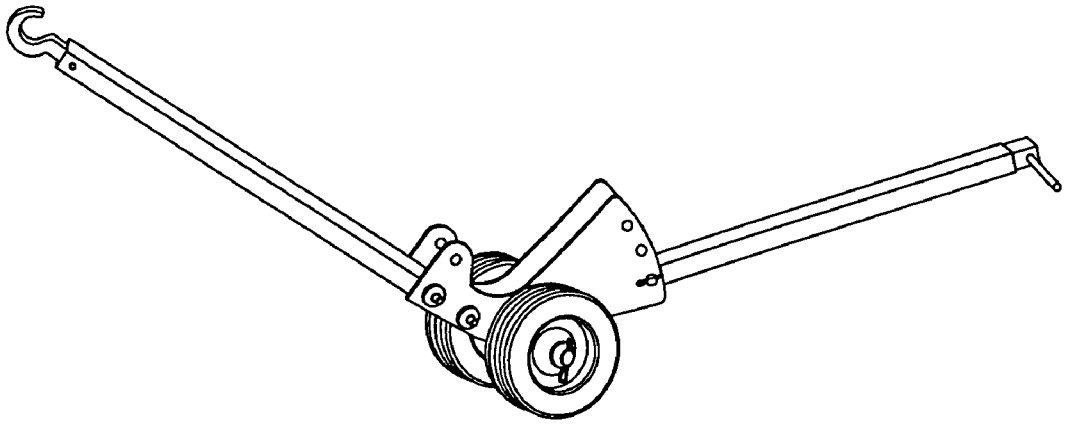
FIG. 10B is a perspective view of the embodiment shown in FIG. 9, wherein the first lever arm is in the first operative position.
Figure 10C:
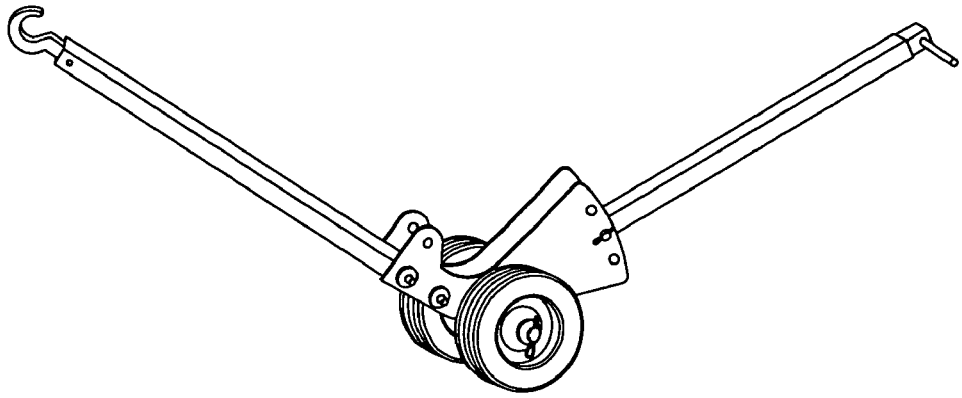
FIG. 10C is a perspective view of the embodiment shown in FIG. 9, wherein the first lever arm is in the second operative position.
Figure 10D:
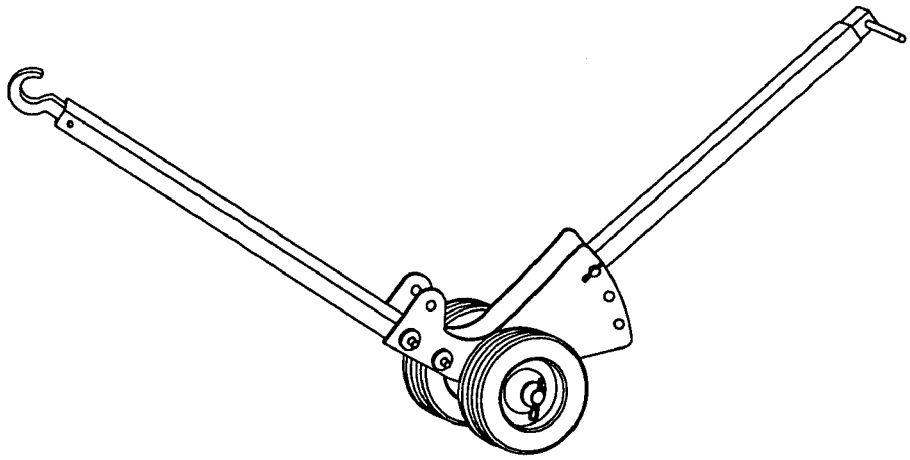
FIG. 10D is a perspective view of the embodiment shown in FIG. 9, wherein the first lever arm is in the third operative position.

Another embodiment of the manhole cover lift of the present invention is shown in FIG. 9, wherein the joint 32 is replaced by a hinge 120. As will be described in detail herein, the first lever arm 20 is pivotally connected to the hinge 120, and the second lever arm 26 is rigidly connected to the hinge 120. Thus, the first lever arm 20 may pivot with respect to the second lever arm 26 between a collapsed position, wherein the first lever arm 20 is substantially parallel to the second lever arm 26, and a plurality of operative positions, wherein the first lever arm 20 extends at a non-parallel angle with respect to the second lever arm 26 to thereby define a lever 12 for applying leverage to the magnetic units 16 for lifting the manhole cover 18.

In order to supportably connect the first lever arm 20 to the second lever arm 26, the hinge 120 has a first hinge plate 122 and a second hinge plate 124. The first hinge plate 122 and the second hinge plate 124 are substantially identical to one another. Furthermore, when connected to the first lever arm 20 and the second lever arm 26, the first and second hinge plates 122, 124 are substantially parallel to one another and spaced apart by the first and second lever arms 20, 26. Each of the first and second hinge plates 122, 124 has a base portion 140, a first flange portion 142, and a second flange portion 144, as will be described in detail herein.

The first lever arm 20 is connected to the hinge 120 by a pivot pin 126. The pivot pin 126 extends through the first flange portion 142 of each of the first hinge plate 122 and the second hinge plate 124. The pivot pin 126 also extends through the first lever arm 20, near the fulcrum end 22 of the first lever arm 20, to retain the first lever arm 20 between the first hinge plate 122 and the second hinge plate 124. The pivot pin 126 is connected to the first and second hinge plate 122, 124 by conventional fasteners, and the first lever arm 20 is able to pivot freely with respect to the pivot pin 126.

The second lever arm 26 is rigidly connected to the hinge 120 by a pair of bolts 128. The bolts 128 extend through the first hinge plate 122, the second lever arm 126, and the second hinge plate 124 at the base portion 140 of the first and second hinge plates 122, 124. The pair of bolts 128 are spaced longitudinally with respect to the second lever arm 26, such that the second lever arm 26 is restrained from rotating with respect to the first and second hinge plates 122, 124. The bolts 128 are connected to the first and second hinge plates 122, 124 by conventional fasteners. Although the first and second hinge plates 122, 124 are described herein as being connected to the second lever arm 26 by a pair of bolts 128, it should be noted that other conventional fasteners could be used or, alternatively, the first and second hinge plates 122, 124 could be welded to the second lever arm 26.

In order selectively to restrain pivotal movement of the first lever arm 20 with respect to the second lever arm 26, a locking member, such as a locking pin 130, is engageable with the first hinge plate 122, the second hinge plate 124, and the first lever arm 20. For this purpose, a locking hole 21 is formed through the first lever arm 20 a short distance, for example, four to eight inches, from the fulcrum end 22 of the first lever arm 20. So that the first lever arm 20 may be restrained from pivoting with respect to the second lever arm 26 in a plurality of positions and consequently a plurality of angular relationships, a plurality of apertures 132, 134, 136, 138 are formed through the first hinge plate 122 and the second hinge plate 124. In particular, a first locking aperture 132, a second locking aperture 134, and a third locking aperture 136 are formed through the first flange portion 142 of each of the first hinge plate 122 and the second hinge plate 124. The first, second, and third locking apertures 132, 134, 136 are formed at discrete locations at the first and second hinge plates 122, 124 along the arc traced by the locking hole 21 through the first lever arm 20 as the first lever arm 20 pivots with respect to the pivot pin 126. In this manner, a plurality of operative positions, that is, positions wherein the first lever arm 20 extends at a non-parallel angle with respect to the second lever arm 26 to thereby define a lever, are defined. In particular, the first locking aperture 132 defines a first operative position, wherein the first lever arm 20 extends at an angle of about 120° with respect to the second lever arm 26. The second locking aperture 134 defines a second operative position, wherein the first lever arm 20 extends at an angle of about 105° with respect to the second lever arm 26. Finally, the third locking aperture 136 defines a third operative position, wherein the first lever arm 20 extends at an angle of about 90° with respect to the second lever arm 26. However, it should be noted that the present invention is not limited to three operative positions or to the specific angles described herein.

Rather, the present invention may include as many operative positions as desired, at whatever angles are desired.

So that the manhole cover lift 10 may be collapsed for storage and transportation, a storage locking aperture 138 is formed through the second flange portions 144 of the first hinge plate 122 and the second hinge plate 124. When the locking hole 21 of the first lever arm 20 is aligned with the storage locking aperture 138 of the first and second hinge plates 122, 124, the locking pin 130 may be disposed in the locking hole through the first lever arm 20 and consequently, through the first hinge plate 122 and the second hinge plate 124 to thereby define a collapsed position of the manhole cover lift 10.

In operation, the user of the manhole cover lift 10 moves the first lever arm 20 from the collapsed position to one of the plurality of operative positions, by first removing the locking pin 130 from the storage locking aperture 138, so that the first lever arm 20 may pivot with respect to the second lever arm 26. The user then pivots the first lever arm 20 toward the first flange portion 142 of the first and second hinge plates 122, 124. The user then selects a desired operative position and aligns the locking hole 21 in the first lever arm 20 with the appropriate locking aperture of the plurality of locking apertures 132, 134, 136. For example, to establish a 105° angle between the first lever arm 20 and the second lever arm 26, the user aligns the locking hole in the first lever arm 20 with the second locking aperture 134. The user then inserts the locking pin 130 through the second locking aperture 134 in the first and second hinge plates 122, 124, and through the locking hole 21 in the first lever arm 20. Once the first lever arm 20 is secured with respect to the hinge 120, the manhole cover lift 10 may be used in substantially the same manner described in connection with the previously-disclosed embodiments. When the user wishes to collapse the manhole cover lift 10, the user removes the locking pin 130 from the second locking aperture 134, pivots the first lever arm 20 toward the second lever arm 26 until the first and second lever arms 20, 26 are substantially parallel and then inserts the locking pin through the storage locking aperture 138 and the locking hole 21 in the first lever arm 20, which are then in alignment.

While the invention has been described in connection with what is presently considered to be the most practical and preferred embodiments, the invention is not limited to those disclosed embodiments. On the contrary, it is intended to cover various modifications and equivalent arrangements included within the spirit and scope of the appended claims, which scope is to be accorded the broadest interpretation so as to encompass all such modifications and equivalent structures as is permitted under the law.

I claim:

1. An apparatus for moving a manhole cover, comprising:

a lever having a first lever arm pivotally connected to a second lever arm by a hinge for movement between a collapsed position, wherein the first lever arm is substantially parallel to the second lever arm, and a plurality of operative positions, wherein the first lever arm extends at a non-parallel angle with respect to the second lever arm;

a locking member configured to restrain pivotal movement of the first lever arm with respect to the second lever arm in each of the operative positions;

a linkage connected to an engaging end of the lever; and at least one magnet connected to the linkage and engageable with the manhole cover.

2. The apparatus for moving a manhole cover of claim 1, further comprising:

the locking member engageable with the hinge and engageable with the first lever arm for restraining pivotal movement of the first lever arm with respect to the hinge in each of the operative positions.

3. The apparatus for moving a manhole cover of claim 1, further comprising:

the at least one magnet having an interface surface selectively engageable with the manhole cover.

4. The apparatus for moving a manhole cover of claim 3, further comprising:

the at least one magnet having a handle movable between an engaged position, wherein a magnetic flux is emitted through the interface surface of the at least one magnet, and a disengaged position, wherein substantially no magnetic flux is emitted through the interface surface of the at least one magnet.

5. The apparatus for moving a manhole cover of claim 3, further comprising:

the at least one magnet being at least one electromagnet.

6. The apparatus for moving a manhole cover of claim 1, further comprising:

the linkage being a hook.

7. The apparatus for moving a manhole cover of claim 6, further comprising:

a slot provided in the second lever arm of the lever wherein the hook is disposed within the slot.

8. The apparatus for moving a manhole cover of claim 6, further comprising:

a plurality of holes provided on the hook wherein each hole is engageable with the second lever arm of the lever.

9. The apparatus for moving a manhole cover of claim 1, further comprising:

the linkage having a chain.

10. The apparatus for moving a manhole cover of claim 1, further comprising:

the linkage having a spreader bar.

11. The apparatus for moving a manhole cover of claim 1, further comprising:

a handle connected to a handle end of the first lever arm of the lever.

12. The apparatus for moving a manhole cover of claim 1, further comprising:

a wheel for movably supporting the lever; and a wheel chock.

13. An apparatus for moving a manhole cover, comprising:

a first lever arm having a fulcrum end and a handle end;

a second lever arm having a fulcrum end and an engaging end;

a hinge pivotally connected to the fulcrum end of the first lever arm and rigidly connected to the fulcrum end of the second lever arm for pivoting the first lever arm with respect to the second lever arm between a collapsed position, wherein the first lever arm is substantially parallel to the second lever arm, and a plurality of operative positions, wherein the first lever arm extends at a non-parallel angle with respect to the second lever arm;

a locking member engageable with the hinge and engageable with the first lever arm for restraining pivotal movement of the first lever arm with respect to the second lever arm in each of the operative positions;

a linkage connected to the engaging end of the second lever arm; and at least a first magnet connected to the linkage and engageable with the manhole cover.

14. The apparatus for moving a manhole cover of claim 13, further comprising:

a hook connected to the engaging end of the second lever arm of the lever;

a spreader bar engageable with the hook;

the first magnet connected to the spreader bar and selectively engageable with the manhole cover; and at least a second magnet connected to the spreader bar and selectively engageable with the manhole cover.

15. The apparatus for moving a manhole cover of claim 14, further comprising:

a housing enclosing each of the first and second magnets;

each housing of the first and second magnets each having an interface surface; and the first and second magnets each having a handle movable between an engaged position, wherein a magnetic flux is emitted through the interface surface of the housing of the magnet, and a disengaged position, wherein substantially no magnetic flux is emitted through the interface surface of the housing of the magnet.

16. The apparatus for moving a manhole cover of claim 13, further comprising:

the plurality of operative positions including at least three discrete operative positions wherein the first lever arm is disposed at a non-parallel angle with respect to the second lever arm.

17. The apparatus for moving a manhole cover of claim 14, further comprising:

the plurality of operative positions including at least a first operative position wherein the first lever arm is disposed at an angle of about 90 degrees with respect to the second lever arm, a second operative position wherein the first lever arm is disposed at an angle of about 105 degrees with respect to the second lever arm, and a third operative position wherein the first lever arm is disposed at an angle of about 120 degrees with respect to the second lever arm.

18. An apparatus for moving a manhole cover, comprising:

a first lever arm having a fulcrum end and a handle end;

a second lever arm having a fulcrum end and an engaging end;

a first hinge plate and a second hinge plate, the first and second hinge plates pivotally connected to the fulcrum end of the first lever arm and rigidly connected to the fulcrum end of the second lever arm such that the first and second hinge plates are substantially parallel and disposed on opposite sides of the first and second lever arms;

a locking member engageable with the first and second hinge plates and engageable with the first lever arm for restraining pivotal movement of the first lever arm with respect to the second lever arm in a collapsed position, wherein the first lever arm is substantially parallel to the second lever arm, and a plurality of operative positions, wherein the first lever arm extends at a non-parallel angle with respect to the second lever arm;

a linkage connected to the engaging end of the second lever arm; and at least a first magnet connected to the linkage and engageable with the manhole cover.

19. The apparatus for moving a manhole cover of claim 18, further comprising:

a locking hole formed through the first lever arm;

a plurality of apertures formed through the first and second hinge plates; and the locking member being a pin extendable through the locking hole in the first lever arm and a selected aperture of the plurality of apertures of the first and second hinge plates to define the collapsed position or one of the plurality of operative positions.

20. The apparatus for moving a manhole cover of claim 18, further comprising:

the plurality of operative positions including at least three discrete operative positions wherein the first lever arm is disposed at a non-parallel angle with respect to the second lever arm.

* * * * *